United States Patent [19]

Halbardier

[11] Patent Number: 4,708,208

[45] Date of Patent: Nov. 24, 1987

[54] METHOD AND APPARATUS FOR SETTING, UNSETTING, AND RETRIEVING A PACKER FROM A SUBTERRANEAN WELL

[75] Inventor: Floyd A. Halbardier, Pasadena, Tex.

[73] Assignee: Baker Oil Tools, Inc., Orange, Calif.

[21] Appl. No.: 877,421

[22] Filed: Jun. 23, 1986

[51] Int. Cl.[4] ..... E21B 33/127; E21B 33/13

[52] U.S. Cl. ..... 166/387; 166/123; 166/182; 277/34.3

[58] Field of Search ..... 166/123, 181, 182, 187, 166/373, 374, 387; 277/3, 34, 34.3, 34.6

[56] References Cited

U.S. PATENT DOCUMENTS

| | | | |
|---|---|---|---|
| 3,044,553 | 7/1962 | Bradley | 277/34 |
| 3,762,470 | 10/1973 | Eggleston | 166/182 |
| 3,912,014 | 10/1975 | Wetzel | 166/240 |
| 4,003,581 | 1/1977 | Hutchison | 166/187 |
| 4,082,298 | 4/1978 | Sanford | 277/34.3 |
| 4,163,562 | 8/1979 | Sanford | 277/34.3 |
| 4,566,535 | 1/1986 | Sanford | 166/152 |

*Primary Examiner*—Stephen J. Novosad
*Assistant Examiner*—Terry L. Melius
*Attorney, Agent, or Firm*—Norvell & Associates

[57] ABSTRACT

Methods and apparatus are provided for retrieving an inflatable packer of a type which may be passed through a small diameter tubing, seal against a relatively large diameter casing by passing fluid to the packer through a remedial tubing, and then be retrieved to the surface through the small diameter tubing. If the downhole equipment assembly becomes hung up during retrieval, fluid may be passed through the remedial tubing to release an upper portion of the packer actuator assembly from a lower portion of the packer actuator assembly. The released upper portion and remedial tubing may then be retrieved to the surface, and a conventional fishing tool utilized to subsequently retrieve the lower portion and the packer.

18 Claims, 6 Drawing Figures

METHOD AND APPARATUS FOR SETTING, UNSETTING, AND RETRIEVING A PACKER FROM A SUBTERRANEAN WELL

BACKGROUND OF THE INVENTION

1. Field of the Invention

The present invention relates to methods and apparatus for setting and unsetting an inflatable packer in a subterranean oil or gas well by using coiled tubing or remedial tubing for pumping fluids to the packer. More particularly, the invention relates to improved methods and apparatus for retrieving a packer sized to set in a casing through a relatively small diameter production tubing.

2. Description of the Prior Art

Those skilled in the art relating to remedial operations associated with drilling, production, and completion of subterranean oil and gas wells have long utilized threaded or coupled remedial tubing inserted through production tubing for pumping fluids from the surface to one or more inflatable packers. More recently, continuous coiled remedial tubing has frequently replaced threaded or coupled tubing to pass fluid to a packer, since coiled tubing may be more rapidly inserted into the well, and may be easily passed through production tubing and related downhole equipment because its diameter is consistently the same size.

Typical remedial coiled tubing apparatus is described in the 1973 *Composite Catalog of Oil Field Equipment and Services,* at page 662 (Gulf Publishing Co., Houston, Texas), and manufactured by Bowen Tools, Inc. of Houston, Texas. Apparatus relating to this coiled tubing technique is more particularly described in U.S. Pat. Nos. 3,182,877 and 3,614,019.

The need frequently arises in remedial or stimulation operations to pass an inflatable packer through small diameter restrictions, e.g. 3½ inch production tubing, set the packer in relatively large diameter casing, e.g., 7 inch casing, unset the packer, and then retrieve the packer to the surface through the small diameter tubing. Recent advances, such as those disclosed in U.S. Pat. No. 4,349,204, enable inflatable packers to pass through such small diameter tubing, effectively seal with a larger diameter casing, and then be retrievable to the surface through the small diameter tubing.

A significant problem in the art concerns retrieval of the packer and the packer actuation apparatus, side pocket mandrels and similar tooling interconnected to the packer. During retrieval, if the packer or tooling get "hung up" on a restriction and conventional threaded remedial tubing is utilized to supply fluid to the packer, the remedial tubing may be rotated to "free" the mismatch and enable the equipment to be removed through the production tubing. This technique is not utilized with coiled tubing, however, since the coiled tubing cannot be effectively rotated. One technique for alleviating this problem is to attach a partial cone-shaped end to the lower end of the coiled tubing to permit the tubing to slide off the obstruction. Another technique alters the position of the end of the tubing with cams for producing a rotary motion in response to longitudinal motion on the tubing, as disclosed in U.S. Pat. No. 3,912,014.

Another problem associated with the prior art concerns the interconnection of the coiled tubing with the downhole packer actuation assembly. Inflatable packers may be unset by pulling upwardly on the coiled tubing.

Set screws have been utilized to connect the coiled tubing to the packer actuation assembly, and such set screws tend to loosen during downhole operations, allowing the tubing to pull away from the packer actuation assembly. Also, coiled tubing has broken off downhole above the packer actuation assembly/coiled tubing connection. In either event, retrieval of the packer actuation assembly, the packer, and interconnected downhole equipment is then a major problem, often requiring sophisticated fishing tool retrieval techniques.

SUMMARY OF THE INVENTION

Improved methods and apparatus are provided for setting and unsetting an inflatable packer of the type which is passed through a small diameter tubing, effectively seals against a relatively large diameter casing, and is then retrieved to the surface through the small diameter tubing. The packer is set by passing fluid through the remedial tubing to the packer actuation assembly. When pressure increases, a poppet valve opens, exposing a piston member to fluid pressure. When fluid pressure reaches a predetermined level, the piston securing pin shears, permitting fluid to pass to the packer and inflate the packer. When fluid pressure reaches a predetermined maximum preferred value and the packer is set, a plug pin shears, dumping fluid to the well and closing the poppet valve to retain the packer in sealed engagement with the casing. After the remedial or stimulation operation is complete, pressure above and below the packer is applied by opening a port between the interior of the apparatus and the annulus above the packer. The packer is unset by pulling upward on the remedial tubing until a third pin shears, allowing the collet to move axially relative to the housing, dumping fluid from the packer.

During retrieval, the tool may become hung up to the extent that the maximum recommended axial force on the remedial tubing cannot free the obstruction. Rather than break the remedial tubing or the tubing/packer actuator assembly connection, another ball may be dropped through the remedial tubing to seal with a seat on the upper portion of the packer actuation assembly, and fluid again pumped through the remedial tubing to shear a fourth pin, enabling the upper sub assembly to be released from the remainder of the packer actuation assembly. The upper subassembly and remedial tubing may then be retrieved together to the surface, and a conventional fishing tool lowered for grasping an exposed fishing neck portion of the lower subassembly at the actuator assembly. The fishing tool and wireline may then be used to retrieve the remaining portion of the packer actuator assembly, the packer, and interconnected equipment.

DETAILED DESCRIPTION OF PREFERRED EMBODIMENTS

Figure 1:
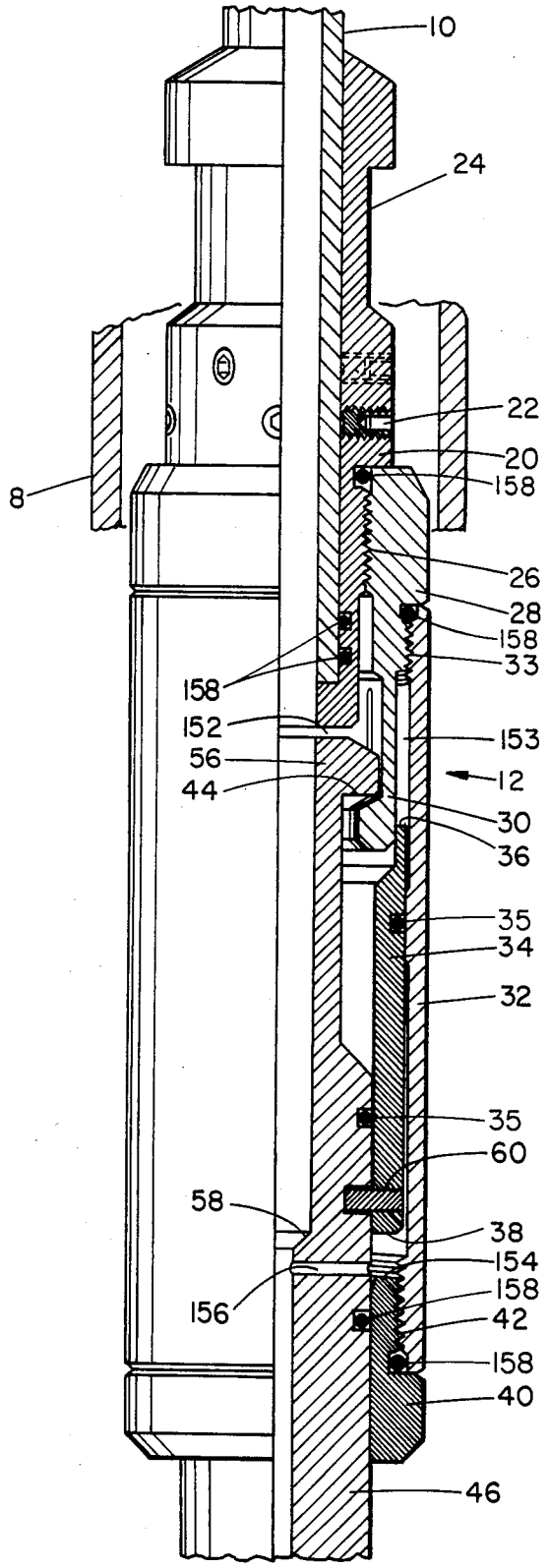
FIGS. 1, 1A, 1B and 1C are vertical sectional views, collectively partially in cross-section, showing the packer actuation assembly, a packer, and a plug according to the present invention.
Figure 1A:
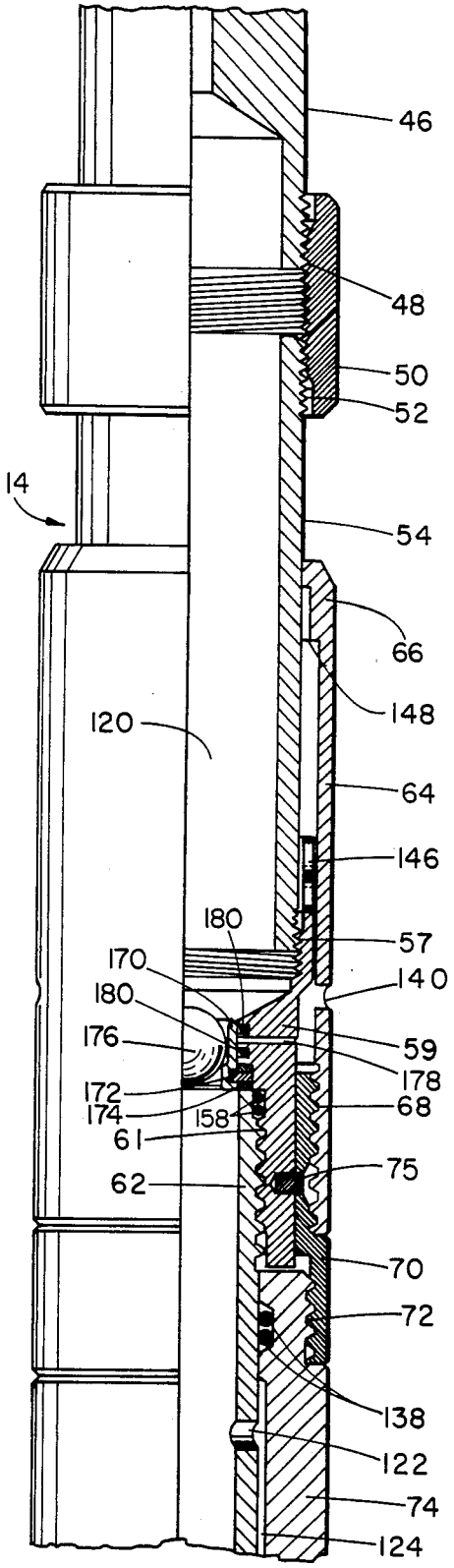
Figure 1B:
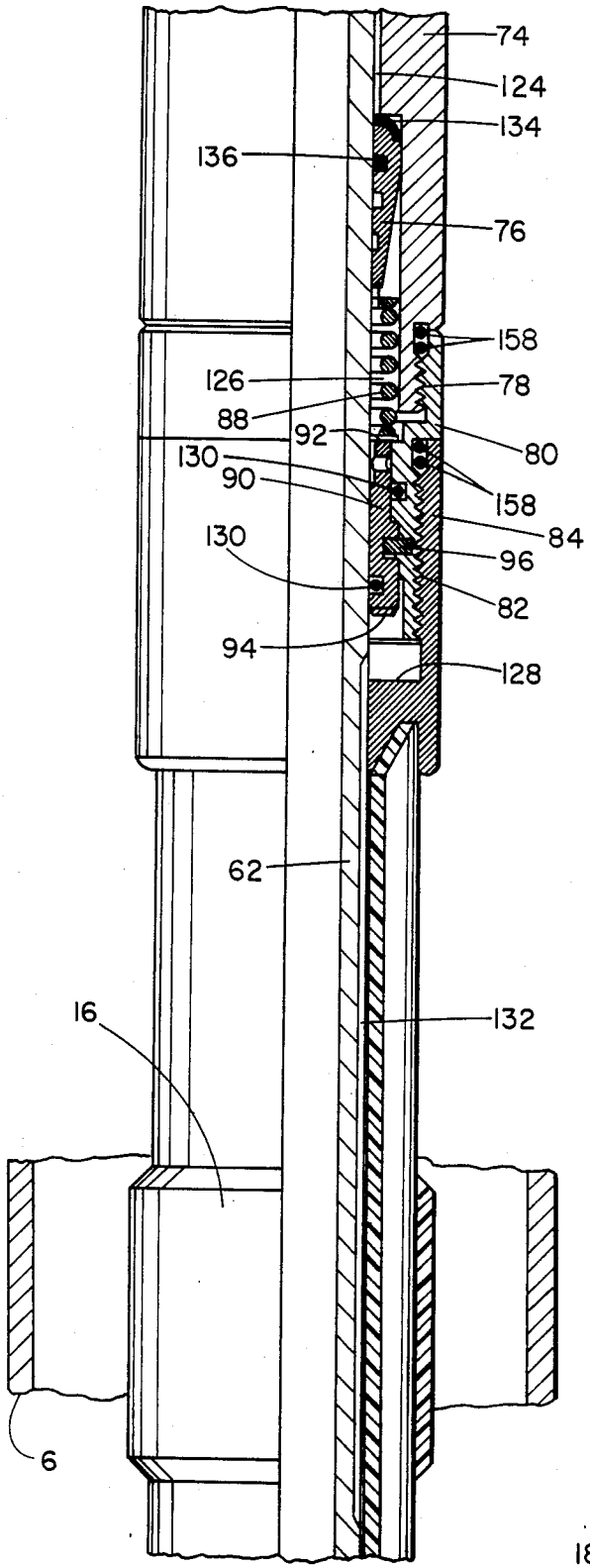
Figure 1C:
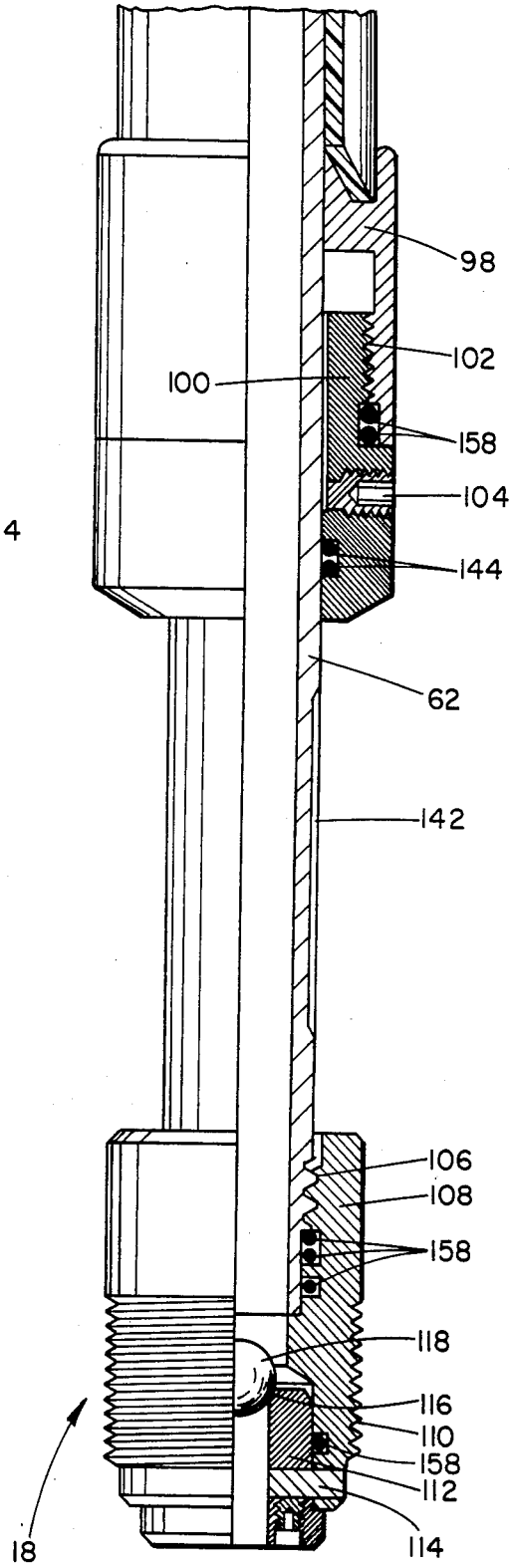

FIGS. 1, 1A, 1B and 1C depict a packer actuator assembly according to the present invention connected to an end of coiled remedial tubing 10. Either coiled tubing 10 or conventional threaded remedial tubing may be utilized to lower the packer to its desired position in a well by passing through production tubing 8. The packer is actuated to seal against the interior surface of casing 6, is subsequently deactivated or "unset", and then may be retrieved to the surface through the production tubing 8. Setting and unsetting of the packer is controlled by passing fluid under pressure from the surface to the packer actuator assembly through the coiled tubing 10.

The packer actuator assembly includes a removable upper subassembly 12 and a main body subassembly 14 described subsequently. The actuator assembly controls passage of fluid to and from packer 16 to set and unset the packer against the interior wall of casing 6. The lower plug assembly 18 is disposed beneath packer 16, and is utilized during the setting and unsetting operation.

Upper sub assembly 12 includes a top sub 20 interconnected to tubing 10 by a plurality of threaded set screws 22. Top sub 20 includes a fishing neck portion 24 for receiving a conventional fishing tool under circumstances described subsequently. The top sub is threaded at 26 for engagement with an upper pilot sub 28 carrying a plurality of collet fingers 30. Outer sleeve 32 is threaded at 33 for engagement with the upper pilot sub 28, and houses piston 34 having an upper surface 36 and a lower surface 38. A lower pilot sub 40 is threaded at 42 for engagement with sleeve 32. When lowering the assembly shown in FIG. 1, 1A, 1B and 1C in the well, subassembly 12 is interconnected to main body subassembly 14 since collet fingers 30 are prevented from moving radially outwardly because of piston 34 which is secured in position by a shear screw 60. The ends of collet fingers 30 thus engage surface 44 of upper sub 46 to prevent axial movement of subassembly 12 relative to subassembly 14.

Upper sub 46 is threaded at 48 to collar 50, which in turn is threaded at 52 to elongate sleeve 54 of subassembly 14. Upper sub 46 includes a fishing neck portion 56 and a ball seat 58 whose function is described subsequently. Slidable piston 34 is normally fixed relative to upper sub 46 by shear pin 60.

The lower end of sleeve 54 is threaded at 57 for engagement with intermediate sub 59, which in turn is threaded at 61 for engagement with sleeve 62. Ball seat 170 covers radial ports 178 in intermediate sub 59. Retainer 174 is sandwiched between sub 59 and sleeve 62, and shear pins 172 interconnect the retainer and the ball seat. Seals 180 provide sealed engagement between ball seat 170 and sub 59. As explained hereafter, ball 176 seats on surface 180, and fluid pressure above the ball shears pins 172, thereby allowing fluid to pass through port 178 in sub 59 and out port 140. The majority of sleeve 54 is protected within housing 64 having an end portion 66 in sliding engagement with the outer surface of sleeve 54.

Housing 64 is threaded at 68 for engagement with pin sub 70, which in turn is threaded at 72 for engagement with lower sub 74. Upward movement of intermediate sub 59 relative to housing 64 is normally prevented by shear pin 75, which interconnects the intermediate sub 59 and the pin sub 70. Lower sub 74 is threaded at 78 to piston sub 80, which in turn is threaded at 82 to upper packer sub 84. Poppet valve 76 is housed between the lower sub 74 and the sleeve 62, and is normally held in the sealed position by a coil spring 88. Slidable piston 90 has an upper piston surface 92 and a lower piston surface 94, and is normally axially secured relative to piston sub 80 by shear pin 96.

Packer 16 is thus positioned between upper packer sub 84 and lower packer sub 98 in a conventional manner. Sub 100 is threaded at 102 with lower packer sub 98, and includes a removable plug 104. The lower end of sleeve 62 is threaded at 106 with plug sub 108, which contains conventional exterior pipe threads 110 for engagement with additional conventional oilfield equipment. Plug 112 is normally secured to plug sub 108 by a plurality of shear pins 114, and contains seat 116 for sealing engagement with ball 118.

It should thus be understood that the entire assembly shown in FIG. 1 may be lowered in a subterranean well through production tubing 8 by a coiled tubing 10. With the packer 16 positioned at a selected position within the casing 6, the packer setting operation may be commenced.

Figure 2:
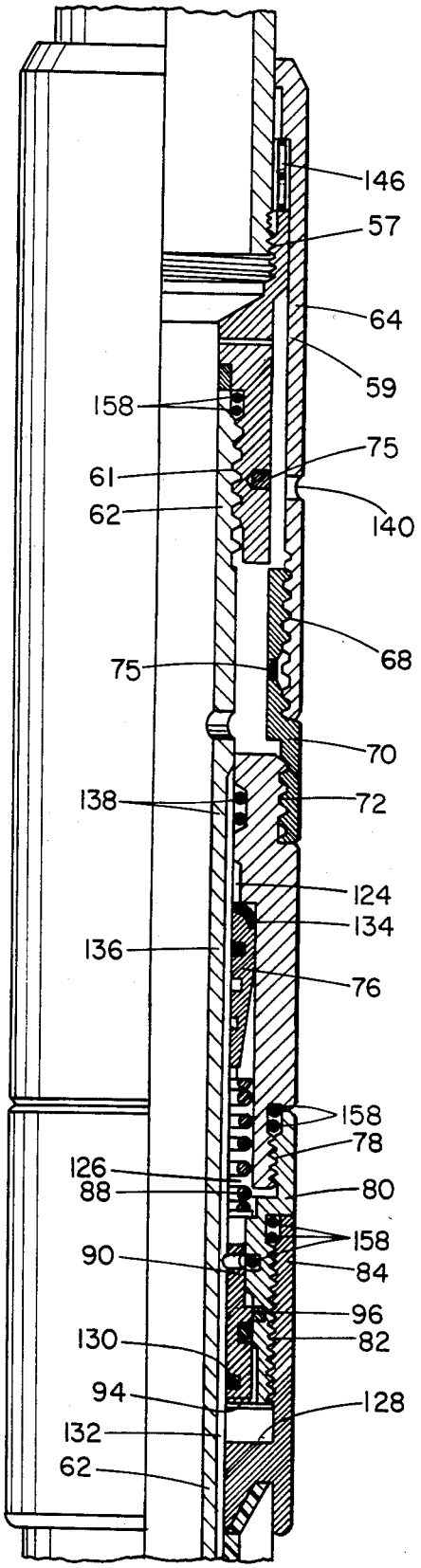
FIG. 2 is a vertical view, partially in crosssection, of a portion of the apparatus shown in FIG. 1 with the sleeve moved axially with respect to the housing to deflate the packer.

To set the packer, ball 118 may be dropped from the surface through coiled tubing 10 and central passageway 120 of the packer setting assembly and engage the plug 112 and seal against seat 116. Pressurized fluid may then be pumped from the surface through the coiled tubing 10 to central passageway 120 and through inflation port 122 in sleeve 62. Pressurized fluid in passageway 124 between sleeve 62 and lower sub 74 thus acts against poppet valve 76, causing poppet valve 76 to compress spring 88 until fluid passes by the poppet valve and into passageway 126. A further increase in fluid pressure acting on upper surface 92 of piston 90 causes pin 96 to shear at a preselected pressure, e.g., 900 p.s.i.g. Piston 90 thus moves downward until surface 94 engages stop surface 128 on upper packer sub 84 (see FIG. 2). It may be seen that downward movement of piston 90 allows fluid to bypass piston seals 130, allowing fluid to pass from passageway 126 to passageways provided by a plurality of elongate upper grooves 132 in sleeve 62, and enabling fluid to pass to the inflatable members in the packer 16 and inflate the packer.

Once the packer has been inflated to effectively seal against the inner wall of the casing 6, the pressure in central passageway 120 will increase until the maxium recommended pressure of the packer is obtained, e.g., 1700 p.s.i.g. At this point, pins 114 will shear, allowing plug 112 and ball 118 to be discharged from plug sub 108, thereby rapidly lowering the pressure in the central passageway 120. This pressure decrease, in combination with spring 88, will cause poppet valve 76 to return to its sealed position, with edge seal 134 returning to sealed engagement with lower sub 74, and seal 136 providing sealing engagement between poppet valve 76 and sleeve 62. Thus once plug 112 is blown out of the bottom of plug sub 108, fluid at the desired pressure of, e.g., 1700 p.s.i.g., is retained within the packer 16 to enable the packer to effectively seal against the casing 6.

When it is desired to unset the packer after completion of the remedial or stimulation operation, intermediate ball 176 may be dropped from the surface through the tubing string, and seat against surface 180. Thereafter, fluid pressure is applied through the tubing string against the ball until the selected fluid pressure, e.g. 1700 p.s.i.g., is sufficient to shear pins 172. Once sheared, the ball and seat are pushed downward through the bore of the tool, and fluid communication is established between the interior 120 of the subassembly 14 and the annulus between the subassembly 14 and the casing 6.

The above-described operation equalizes the pressure in the casing 6 above the packer 16 to approximately the pressure below the packer 16, since fluid in the casing below the packer is free to travel up the central passageway of the tool and through ports 178 and 140 once pins 172 shear. If pressure is not substantially equalized above and below the packer before the packer is depressurized, the higher pressure in the casing 6 below the packer 16 may create a sufficient upward force on the packer to buckle or break the coiled tubing 10. In such a case, not only is the tubing 10 damaged, but the packer 16 thereafter may not be deflated in its intended manner.

Once pressure equalization has occurred, an upward force may be applied to coiled tubing 10, thereby exerting an upward force on intermediate sub 59 relative to pin sub 70. Once a selected upward force, e.g., 3400 pounds, has been applied to tubing 10, pins 75 will shear, enabling sleeve 54 to move upwardly relative to housing 64 (see FIG. 2). As sleeve 62 moves upward with sleeve 54 relative to lower sub 74, upper grooves 132 pass by poppet valve 76 and seals 138, allowing fluid to discharge from the packer through port 140 in housing 64. Simultaneously, a plurality of elongate lower grooves 142 in sleeve 62 provide a flow discharge path from packer 16 past seals 144. Fluid may thus be simultaneously discharged from the packer at locations both above and below the packer, causing the packer to deflate. Upward jarring movement of sleeve 62 relative to lower sub 74 is cushioned when shock absorbing sleeve 146 is compressed between the end of intermediate sub 59 and the stop surface 148 on housing 64.

During the packer retrieval operation, it is possible for the packer or equipment connected therewith to become "hung up" or "caught", so that the removal operation cannot proceed. This "hang up" condition may be due to to a lower component in the assembly below pilot sub, such as the packer, catching on a component in the well. In either event, it is undesirable to exert an upward force on the coiled tubing 10 beyond the recommended force for the coiled tubing, since the tubing may break at a location above the top sub 20, creating a major problem for the subsequent removal of the packer actuator assembly and the packer. According to the present invention, methods and apparatus are provided for enabling subassembly 12 to be disconnected from subassembly 14 when such a hang up condition occurs.

Figure 3:
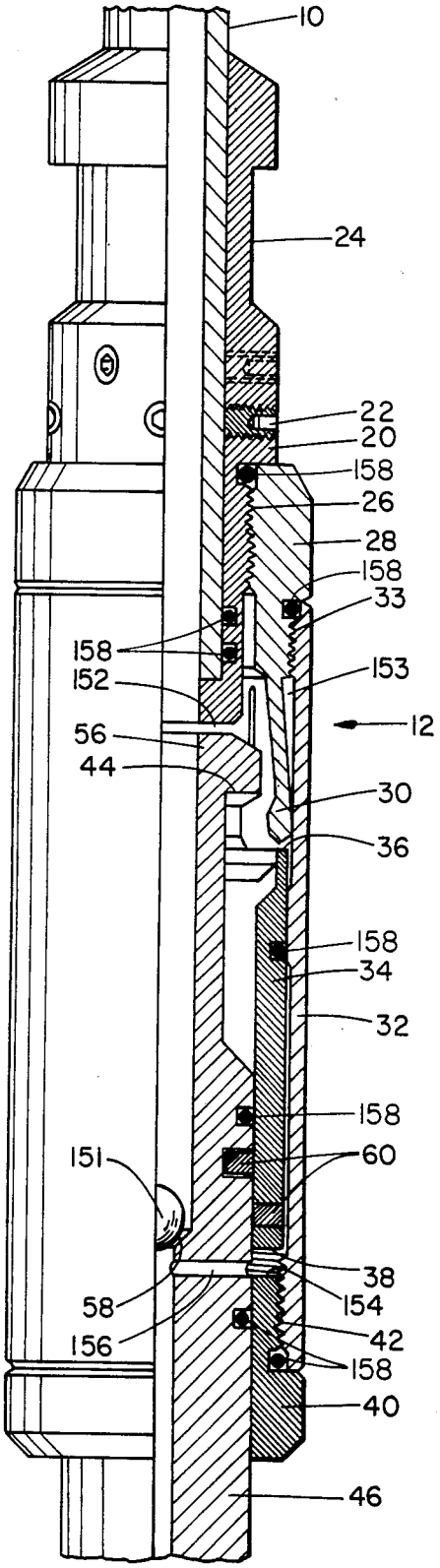
FIG. 3 is a vertical view, partially in crosssection, showing the upper subassembly of the packer actuator assembly in position to be disconnected from the remainder of the actuator assembly.

If the assembly shown in FIG. 1 cannot be freed with the maximum recommended axial force on tubing 10, another ball 151 (see FIG. 3) may be dropped from the surface through the coiled tubing 10 and seat on ball seat 58 of upper sub 46. Thereafter, fluid may be injected through the coiled tubing, causing fluid to pass through gap 152 between upper sub 46 and top sub 20. Fluid passes by the collet fingers 30, and a pressure increase in passageway 153 acts on top surface 36 of piston 34 until a selected fluid pressure, e.g., 1075 p.s.i., is obtained, causing pin 60 to shear and forcing piston 34 downwardly against stop surface 154 (see FIG. 3). Since fluid pressure beneath seat 58 is lower than the pressure above ball 151, the downward movement of piston 34 expels fluid beneath the piston through passageway 156. Once the piston 34 has moved downward, collet fingers 30 are free to move radially outwardly relative to upper sub 46 (see FIG. 3), so that upper pilot sub 28 may become disconnected from upper sub 46. Once the piston has moved downward, the coiled tubing 10 with subassembly 12 may be pulled to the surface, exposing fishing neck portion 56 of upper sub 46 for engagement with a conventional fishing tool. Using a conventional fishing tool and a wireline (not shown), the fishing tool may grasp the special fishing neck portion 56 of upper sub 46, and a substantial upward and/or rotational force exerted on upper sub 56 through the wireline to free the hang up and enable the remaining apparatus, including the packer, to pass through the production tubing 8.

The present invention thus enables the subassembly 12 to be easily detached from the subassembly 14 connected to the packer, so that subassembly 12 may be removed with the coiled tubing rather than subject tubing 10 to a higher than recommended axial force. If, for some reason, tubing 10 should ever become inadvertently disconnected from subassembly 12, the remainder of the tubing 10 may be removed from the wellbore, and a conventional fishing tool lowered by wireline (not shown) for engagement with fishing neck portion 24.

Those skilled in the art will recognize that a plurality of static seals, such as O-rings 158, are provided at the locations indicated in the figures, and maintain sealing engagement between the respective components illustrated. The relatively large diameter passageway 120 enables tooling to be passed down through the assembly shown in FIGS. 1, 1A, 1B and 1C subsequent to the expulsion of plug 112, in order that additional operations may be performed beneath the set packer.

As used herein, the term "remedial" tubing refers to conduit used to pass fluids to a packer to set the packer in a subterranean well, and includes both coiled tubing previously described and threaded or coupled tubing sections.

Although the invention has been described in terms of the specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A method for setting, unsetting, and retrieving an inflatable packer utilizing a downhole packer actuator assembly having an upper connector portion and a lower actuator portion, a remedial tubing string and a wireline in a subterranean well including a large diameter bore and a relatively small diameter tubing string, comprising:

structurally connecting the upper connector portion of the packer actuator assembly and the lower portion of the packer actuator assembly, the upper connector portion of the packer actuator assembly and the remedial tubing string, and the lower actuator portion of the packer actuator assembly and the inflatable packer, thereby suspending the packer actuator assembly and the inflatable packer from the remedial tubing string;

lowering the inflatable packer while suspended from the remedial tubing string downhole through the small diameter tubing string and to a selected location within the subterranean well;

passing pressurized fluid through the remedial tubing string, the lower actuator portion, and to the inflatable packer to set the packer within the large diameter bore;

unsetting the inflatable packer;

passing pressurized fluid through the remedial tubing string and to the packer actuator assembly for releasing the upper connector portion of the packer actuator assembly from the lower actuator portion of the packer actuator assembly;

retrieving the upper connector portion of the packer actuator assembly from the subterranean well through the small diameter tubing string by raising the remedial tubing string from the well while the lower portion of the packer actuator assembly and inflatable packer remain within the well;

structurally interconnecting the wireline and the lower portion of the packer actuator assembly while positioned within the well;

retrieving the lower portion of the packer actuator assembly and the inflatable packer from the subterranean well through the small diameter tubing string by raising the wireline.

2. The method as defined in claim 1, wherein the packer is unset by exerting an upward force on the remedial tubing string.

3. The method as defined in claim 2, wherein the upward force exerted on the tubing string to unset the packer is greater than a preselected force sufficient to enable axial movement of components within the packer actuator assembly to release pressurized fluid from the packer.

4. The method as defined in claim 1, further comprising:

releasing pressurized fluid from the lower packer actuator portion while retaining pressurized fluid within the packer sufficient to maintain the packer set.

5. The method as defined in claim 1, wherein the step of passing pressurized fluid to the packer actuator assembly to release the upper connector portion of the packer actuator assembly from the lower actuator portion of the packer actuator assembly comprises:

dropping a ball through the remedial tubing to seal with a surface on the upper connector portion of the packer actuator assembly.

6. The method as defined in claim 5, further comprising:

restricting release of the upper connector portion of the packer actuator assembly from the lower actuator portion of the packer actuator assembly until pressurized fluid within the remedial tubing string reaches a preected value.

7. The method as defined in claim 1, further comprising:

substantially equalizing pressure above and below the set packer in the annulus between the packer actuator assembly and the large diameter bore.

8. The method as defined in claim 7, wherein the step of substantially equalizing pressure comprises:

sealingly closing a passageway through the packer actuator assembly at a position above the set packer; and increasing fluid pressure in the passageway to a level sufficient to open a port between the passageway and the annulus at a position above the set packer.

9. A method for setting, unsetting, and retrieving an inflatable packer of the type positionable in a subterranean well including a large diameter bore and a relatively small diameter tubing string, comprising:

suspending a packer actuator assembly and the inflatable packer from a flexible coiled tubing string;

lowering the inflatable packer while suspended from the coiled tubing string downhole through the small diameter tubing string and to a selected location within the subterranean well;

passing pressurized fluid through the coiled tubing string and to the inflatable packer to set the packer within the large diameter bore;

sealingly closing a passageway through the packer actuator assembly at a position above the set packer;

increasing fluid pressure in the passageway to a level sufficient to open a port between the passageway and the annulus at a position above the set packer, thereby substantially equalizing pressure above and below the set packer in the annulus between the packer actuator assembly and the large diameter bore so as to substantially eliminate an upward force on the coiled tubing string during a subsequent packer unsetting operation;

exerting an upward force on the coiled tubing string sufficient to enable axial movement of components within the packer actuator assembly to release pressurized fluid from the packer and unset the packer;

retrieving the packer actuator assembly and the packer from the subterranean well through the small diameter tubing string.

10. The method as defined in claim 9, wherein the step of substantially equalizing pressure further comprises:

providing a valve seating means within the packer actuator assembly;

passing a valve means from the surface into sealed engagement with the valve seating means to sealingly close the passageway.

11. The method as defined in claim 9, further comprising:

structurally connecting a first portion of the packer actuator assembly and a second portion of a packer actuator assembly, the first portion of the packer actuator assembly and the coiled tubing string, and the second portion of the packer actuator assembly and the inflatable packer; and passing pressurized fluid through the coiled tubing string and to the packer actuator assembly for releasing the first portion of the packer actuator assembly from the second portion of the packer actuator assembly.

12. The method as defined in claim 11, wherein the step of retrieving the packer actuator assembly and packer comprises:

retrieving the first portion of the packer actuator assembly from the subterranean well through the small diameter tubing string by raising the coiled tubing string from the well while the second portion of the packer actuator assembly and packer remain within the well;

structurally interconnecting a wireline and the second portion of the packer actuator assembly while positioned within the well;

retrieving the second portion of the packer actuator assembly and the packer from the subterranean well through the small diameter tubing string by raising the wireline.

13. Apparatus for retrieving from a subterranean well an inflatable packer of the type positionable within a large diameter well bore by passing through a smaller diameter conduit while suspended from a remedial tubing string and set by passing pressurized fluid to the packer through the remedial tubing string, comprising:

first connection means for structurally connecting an upper tubular portion of the apparatus with the remedial tubing string;

second connection means for structurally connecting a lower tubular portion of the apparatus with the packer;

releasable interconnection means for interconnecting the upper tubular portion of the apparatus with the lower tubular portion the apparatus when in a latched position and for enabling axial movement of the upper portion of the apparatus relative to the lower portion of the apparatus when in the unlatched position; said releasable interconnection means comprising radially shiftable means defining latching means; a fluid pressure chamber adjacent said latching means; an axially shiftable piston shearably secured in said fluid pressure chamber and abutting said latching means to secure same in said latched position; radial port means axially above and below said piston respectively communicating with the bores of said upper and lower tubular portions to normally prevent any pressure differential across said piston; and means for sealing the bore of one of said upper and lower tubular portions intermediate said radial port means, whereby fluid pressure applied through the remedial tubing string applies a fluid pressure differential to said piston to shift said piston axially to release said upper portion of the apparatus from said lower portion of the apparatus.

14. The apparatus of claim 13 wherein said radially shiftable latching means comprises a collet on said upper tubular portion, said collet having peripherally spaced latching heads engaging a downwardly facing, annular, abutment surface on said lower tubular portion, and said piston comprises a sleeve surrounding said collet latching heads in said latched position.

15. The apparatus of claim 14 wherein said downwardly facing annular abutment surface is defined by a fishing neck formed on the top end of said lower portion of the apparatus.

16. Apparatus as defined in claim 13, wherein the radially shiftable latching means comprises:

a first plurality of collet fingers secured to one of the upper portion and the lower portion of the apparatus; and a collet latching surface formed on the other of the upper portion and the lower portion of the apparatus.

17. The apparatus as defined in claim 13, wherein the sealing means is a ball member adapted for sealing engagement with a sealing surface on the lower portion of the apparatus.

18. A method for retrieving an inflatable packer inserted in a subterranean well by a remedial tubing string and susceptible to becoming stuck in the wall during retrieval of the remedial tubing string comprising the steps of:

securing the inflatable packer to a sleeve having a fishing neck on the top thereof;

securing a collet to the bottom end of the remedial tubing string with the collet heads engagable with said fishsing neck;

forming an annular fluid pressure chamber around said collet heads;

shearably securing an annular piston to said sleeve with one portion of said annular piston sealably mounted in said annular piston chamber and another portion securing said collet heads in engagement with said fishing neck;

and supplying fluid pressure through said remedial tubing string to said annular piston to move said annular piston out of engagement with the collet heads to release the remedial tubing string therefrom and expose the fishing neck portion of said sleeve, thereby permitting wireline retrieval of said inflatable packer by engagement of a wireline fishing tool with said fishing neck

* * * * *